US011753868B2

(12) United States Patent
Boyer et al.

(10) Patent No.: US 11,753,868 B2
(45) Date of Patent: Sep. 12, 2023

(54) STEP STOOL WITH MOVEABLE HANDRAIL

(71) Applicant: Dorel Home Furnishings, Inc., Wright City, MI (US)

(72) Inventors: Jason A. Boyer, Columbus, IN (US); Kyle J. Lawrence, Greenfield, IN (US)

(73) Assignee: Dorel Home Furnishings, Inc., Wright City, MI (US)

( * ) Notice: Subject to any disclaimer, the term of this patent is extended or adjusted under 35 U.S.C. 154(b) by 532 days.

(21) Appl. No.: 16/922,532

(22) Filed: Jul. 7, 2020

(65) Prior Publication Data

US 2021/0010327 A1 Jan. 14, 2021

Related U.S. Application Data

(60) Provisional application No. 62/871,284, filed on Jul. 8, 2019.

(51) Int. Cl.

| | |
|---|---|
| ***E06C 7/18*** | (2006.01) |
| ***E06C 7/04*** | (2006.01) |
| ***E06C 1/38*** | (2006.01) |
| *E06C 7/08* | (2006.01) |

(52) U.S. Cl.

CPC ..... *E06C 1/382* (2013.01); *E06C 7/04* (2013.01); *E06C 7/182* (2013.01); *E06C 7/081* (2013.01)

(58) Field of Classification Search

CPC . E06C 1/382; E06C 1/393; E06C 1/22; E06C 7/04; E06C 7/182; E06C 7/081; E06C 7/50

See application file for complete search history.

(56) References Cited

U.S. PATENT DOCUMENTS

| | | | | | |
|---|---|---|---|---|---|
| 2,467,800 | A * | 4/1949 | Backlin | E06C 7/182 | 182/106 |
| 2,620,210 | A * | 12/1952 | Wuster | F16B 7/105 | 403/377 |
| 3,856,112 | A * | 12/1974 | Stewart | E06C 1/22 | 182/172 |
| 4,830,035 | A * | 5/1989 | Liu | A61H 3/00 | 403/325 |
| 5,722,507 | A * | 3/1998 | Kain | E06C 1/393 | 182/104 |
| 6,079,894 | A * | 6/2000 | Obitts | A61H 3/02 | 403/109.2 |
| 7,255,198 | B1 * | 8/2007 | Lo | E06C 1/22 | 182/172 |
| 7,383,920 | B2 * | 6/2008 | Meeker | E06C 7/14 | 182/129 |
| 7,445,398 | B2 * | 11/2008 | Stockler | A47B 9/14 | 403/379.5 |
| 8,485,488 | B2 * | 7/2013 | Forrest | A47C 3/20 | 248/407 |
| 9,016,434 | B2 * | 4/2015 | Moss | E06C 1/39 | 182/180.1 |

(Continued)

*Primary Examiner* — Brian D Mattei
*Assistant Examiner* — Kathleen M. McFarland
(74) *Attorney, Agent, or Firm* — Barnes & Thornburg LLP

(57) ABSTRACT

A step stool includes a step frame including a plurality of legs and a handrail coupled to the step frame. The step frame is foldable so as to assume a flat profile for storage. The handrail is mounted on the step frame and is movable relative to the step frame. The handrail provides support for a user standing on the step frame.

20 Claims, 14 Drawing Sheets

(56) References Cited

U.S. PATENT DOCUMENTS

| | | | | |
|---|---|---|---|---|
| 10,844,660 | B2 * | 11/2020 | Leng | E06C 1/387 |
| 10,876,356 | B2 * | 12/2020 | Russell | E06C 7/50 |
| 11,149,493 | B2 * | 10/2021 | Boyer | E06C 7/182 |
| 11,225,833 | B2 * | 1/2022 | Yoo | E06C 1/393 |
| 11,319,751 | B2 * | 5/2022 | Zhu | E06C 1/22 |
| 11,459,824 | B2 * | 10/2022 | Cohen | E06C 7/186 |
| 2003/0135955 | A1 * | 7/2003 | Dove | B25G 1/04 16/429 |
| 2004/0000449 | A1 * | 1/2004 | Meeker | E06C 1/387 182/165 |
| 2008/0251319 | A1 * | 10/2008 | Meyers | E06C 1/397 182/152 |
| 2017/0058930 | A1 * | 3/2017 | Liu | F16B 7/105 |
| 2018/0148977 | A1 * | 5/2018 | Leng | E06C 1/393 |
| 2018/0347278 | A1 * | 12/2018 | Russell | E06C 1/16 |
| 2019/0061629 | A1 * | 2/2019 | Gemme | E06C 7/182 |
| 2019/0330920 | A1 * | 10/2019 | Boyer | E06C 1/383 |
| 2020/0115959 | A1 * | 4/2020 | Cohen | E06C 7/182 |
| 2020/0217134 | A1 * | 7/2020 | Fortier | F16B 7/105 |
| 2020/0240207 | A1 * | 7/2020 | Zhu | E06C 1/22 |
| 2020/0240209 | A1 * | 7/2020 | Zhu | E06C 1/22 |
| 2020/0248507 | A1 * | 8/2020 | Moss | E06C 7/182 |
| 2020/0325726 | A1 * | 10/2020 | Yoo | E06C 1/18 |
| 2020/0378185 | A1 * | 12/2020 | Leng | E06C 7/06 |
| 2020/0386050 | A1 * | 12/2020 | Mittanck | E06C 7/50 |
| 2021/0010327 | A1 * | 1/2021 | Boyer | E06C 1/22 |

* cited by examiner

STEP STOOL WITH MOVEABLE HANDRAIL

PRIORITY CLAIM

This application claims priority under 35 U.S.C. § 119(e) to U.S. Provisional Application Ser. No. 62/871,284, filed Jul. 8, 2019, which is expressly incorporated by reference herein.

BACKGROUND

The present disclosure relates to a step stool and particularly to a foldable step stool. More particularly, the present disclosure relates to a foldable step stool including steps mounted on a frame and a handrail mounted for movement relative to the frame.

Step stools have a step frame and one or more steps that people use for elevation when reaching for objects, painting walls, or any everyday task where extra elevation would be helpful. Step frames are often foldable for ease of storage when the step stool is not being used.

SUMMARY

According to the present disclosure, a step stool includes a step frame and a handrail movable relative to the step frame between lowered and raised positions. In illustrative embodiments, the handrail includes a handle and non-splayed left and right handle-support arms coupled to the handle to move as a unit with the handle as the handrail is moved relative to the step frame between the raised and lowered positions.

In illustrative embodiments, the step frame includes front left and right legs, rear left and right legs, and several steps mounted for pivotable movement on the legs during folding of the step stool to place the step frame in a COLLAPSED-STORAGE mode and during unfolding of the step stool to place the step frame in an EXPANDED-USE mode. The step frame also includes a pair of foldable step-support linkages that are coupled to rear ends of the steps and to the rear left and right legs to control pivoting motion of the steps relative to the front left and right legs during folding and unfolding of the step stool.

In illustrative embodiments, the step frame further includes a handle retainer comprising separate sets of upper and lower spring-biased, handrail-locking bolts mounted for lateral sliding movement on each of the front left and right legs to project a tip of each bolt in a forward direction through a bolt-receiving aperture formed in a companion one of the legs. The step stool further includes a slidable handrail mounted on the front left and right legs for up-and-down movement between a lowered position and a relatively-higher raised position. In the lowered position, each of the lower spring-biased, handrail-locking bolts is also urged to extend through a companion bolt-receiving aperture formed in the handrail to retain the handrail in the lowered position on the step frame regardless of whether the step frame is in the COLLAPSED-STORAGE mode or the EXPANDED-USE mode. In the raised position, each of the upper spring-biased, handrail-locking bolts is also urged to extend through a companion bolt-receiving aperture formed in the handrail to retain the handrail in the raised position on the step frame regardless of whether the step frame is in the COLLAPSED-STORAGE mode or the EXPANDED-USE mode.

In illustrative embodiments, the step stool further includes a handrail-release unit coupled to a lower end of one of the left and right handle-support arms included in the handrail to support the handle also included in the handrail. Each handrail-release unit includes a hand grip coupled to the lower end of each of the left and right handle-support arms and a bolt pusher that is movable relative to the companion hand grip by a user to apply a bolt-retracting force to the tip of a companion spring-biased, handle-locking bolt to cause such bolt to move in a rearward direction to exit the companion bolt-receiving aperture formed in the handrail and to the companion bolt-receiving aperture formed in the handrail when the handrail is in the raised position to free the handrail for up-and-down sliding movement on the front legs of the step frame.

In illustrative embodiments, each of the left and right handle-support arms of the handrail has a C-shaped cross-section and is a sleeve that is formed to include an interior region sized to receive one of the front legs of the step frame therein to facilitate up-and-down movement of each arm on its companion leg. Each of the left and right handle-support arms is formed to include a vertically extending slot along its length that faces toward the steps. And the handle-support arms are aligned so that their vertically extending slots face toward one another when the handrail is stationary and when the handrail moves up and down on the front legs of the step frame.

Additional features of the disclosure will become apparent to those skilled in the art upon consideration of the following detailed descriptions of the illustrative embodiments exemplifying the best mode of carrying out the disclosure as presently perceived.

BRIEF DESCRIPTION OF THE DRAWINGS

The detailed description particularly refers to the accompanying figures in which.

DESCRIPTION

Figure 1:
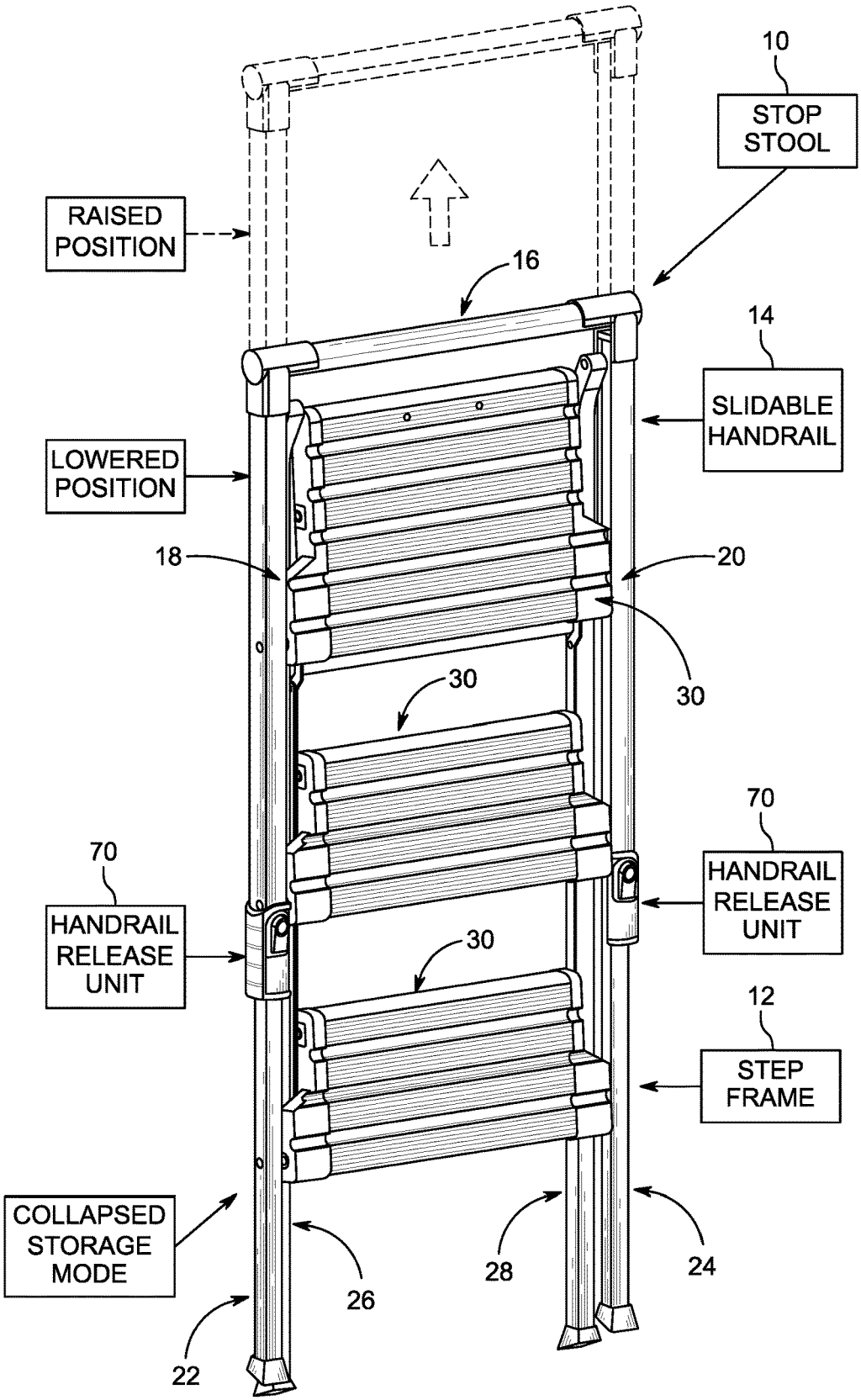
FIG. 1 is a perspective of a collapsed step stool in accordance with a first embodiment of the present disclosure showing a step frame comprising three steps, two front legs, and two rear legs and showing a handrail in a lowered position (in solid) relative to the step frame and suggesting upward movement of the handrail relative to the step frame to a raised position (in phantom)
Figure 2:
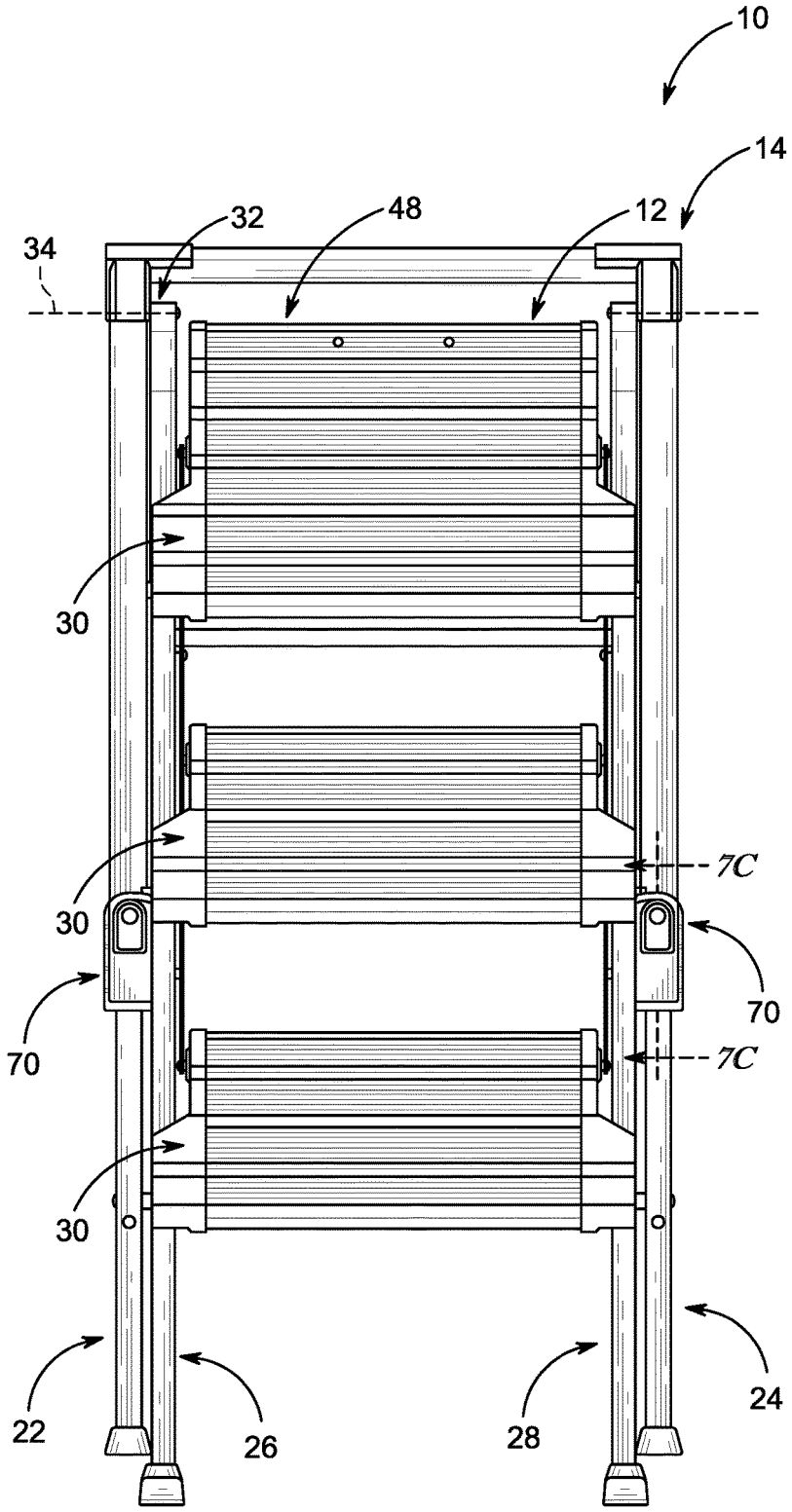
FIG. 2 is a front elevation view of the collapsed step stool showing (in series, left to right) a front left leg, a rear left leg, a front right leg, and a rear right leg of the step frame wherein all of the legs are arranged to lie in a spaced-apart parallel relation to one another when the step frame is folded to assume a COLLAPSED-STORAGE mode and showing that the handrail has an inverted U-shape and that the handrail is retained in the lowered position on the front left and right legs of the step frame.
Figure 3:
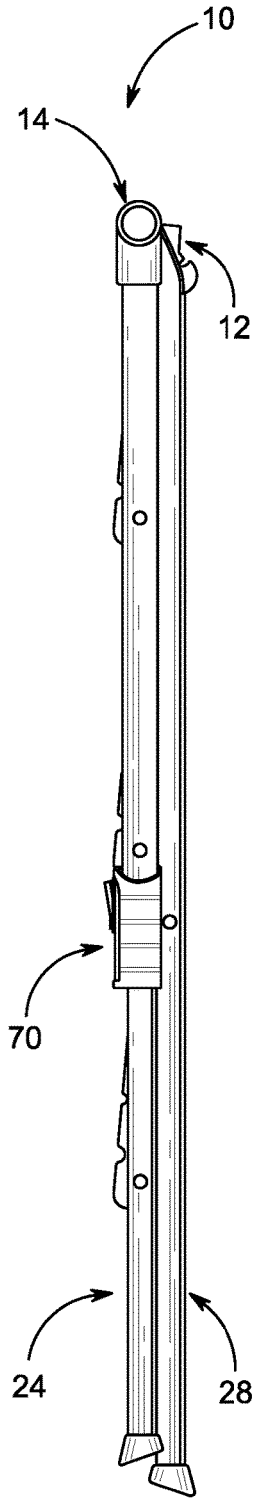
FIG. 3 is a side elevation view of the collapsed step stool of FIG. 2 showing a FLAT-FOLD feature of the step stool.
Figure 4:
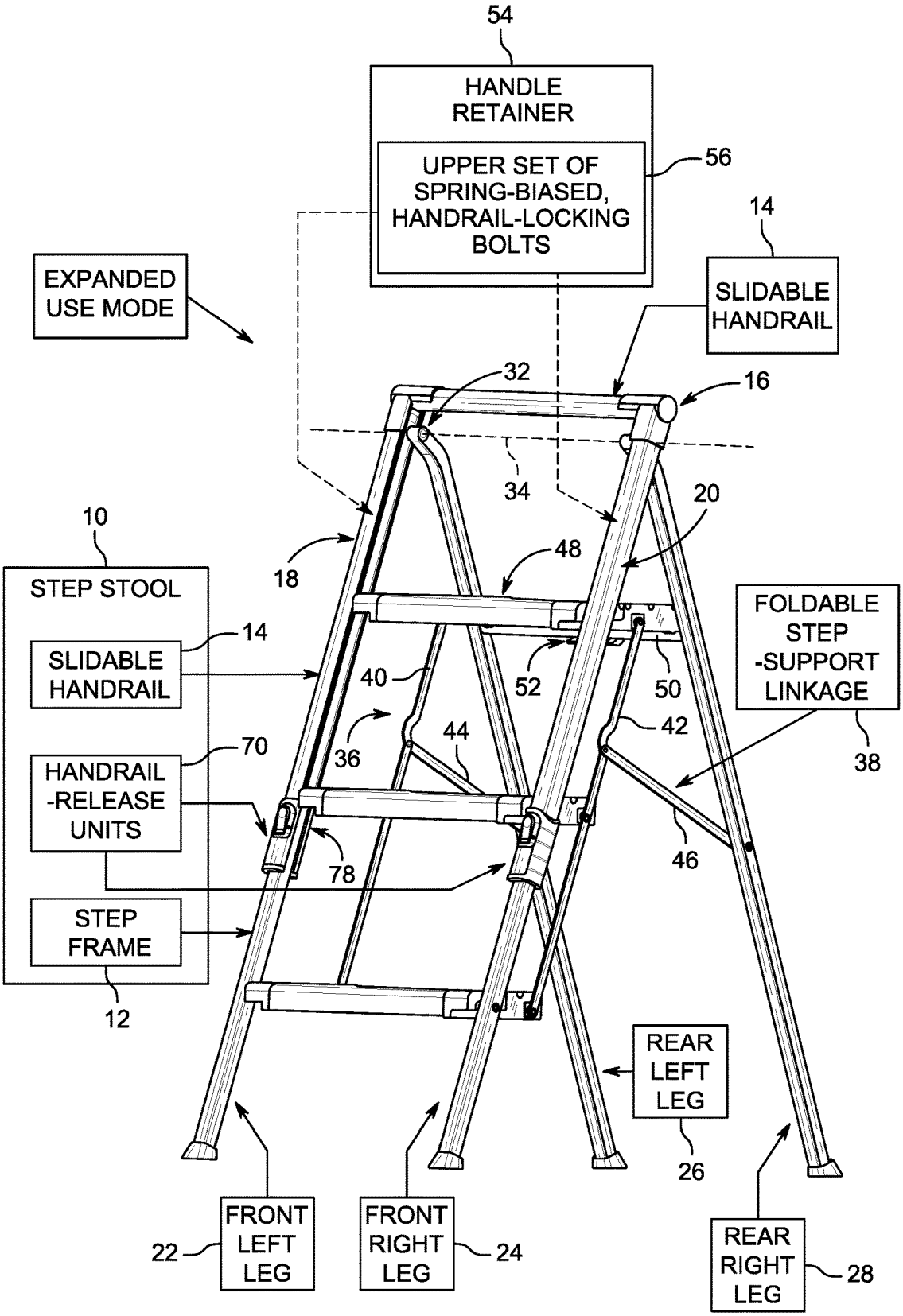
FIG. 4 is a perspective view of the step frame of the step stool of FIGS. 1-3 in an EXPANDED-USE mode showing that the step stool comprises a step frame, a pair of foldable step-support linkages coupled to the steps and to the rear legs, a handrail mounted for up-and-down movement on the front legs of the step frame, and a pair of handrail-release units coupled to the handrail to move therewith relative to the step frame and configured to be operated by a user of the step stool to disable a handrail retainer that is included in the step frame and used to retain the handrail in either a lowered position on the step frame as shown in FIG. 4 or a raised position on the step frame as shown in FIG. 5 and showing the handrail in a lowered position on the front legs of the step frame and showing exposed tips of an upper set of spring-biased, handrail-locking bolts included in the handrail retainer and mounted for forward and rearward sliding movement on the front left and right legs above the top step and used to retain the handrail in the raised position on the front legs of the step frame as suggested in FIG. 5.

A step stool 10, in accordance with the present disclosure, includes a step frame 12 and a handrail 14 movable relative to the step frame 12 between lowered and raised positions as shown in FIG. 1. Handrail 14 moves down relative to step frame 12 to assume the lowered position to save space when step stool 10 is stored in a COLLAPSED-STORAGE mode as shown in FIGS. 2 and 3. Handrail 14 moves up to assume the raised position to provide support for a user standing on the step stool when step stool 10 is in an EXPANDED-USE mode as shown in FIG. 4. Step stool 10 further includes a handrail-release unit 70 coupled to handrail 14 to disengage handrail 14 from step frame 12 so that handrail 14 can move relative to step frame 12 to change between the raised and the lowered positions Handrail 14 includes a handle 16 and non-splayed left and right handle-support arms 18, 20 coupled to handle 16 to move as a unit with handle 16 as handrail 14 is moved relative to step frame 12 between the raised and lowered positions as suggested in FIG. 1 and shown in FIG. 4. Handle 16 extends horizontally between and interconnects left handle-support arm 18 and right handle-support arm 20 to provide a support for a user to use to balance oneself while standing on step stool 10. Left and right handle-support arms 18, 20 mount handle 16 to step frame 12 for sliding movement on and relative to step frame 12 between the lowered and raised positions.

Step frame 12 is configured to support a user in an elevated positon above ground and includes front left and right legs 22, 24, rear left and right legs 26, 28, and a plurality of steps 30 as shown in FIGS. 2-4. Front left and right legs 22, 24 are mounted to rear left and right legs 26, 28 at an upper end 32 of step frame 12 for pivotable movement about a step-frame pivot axis 34 between the COLLAPSED-STORAGE mode and the EXPANDED-USE mode. Each of the plurality of steps 30 are mounted to the front left and right legs 22, 24 for pivotable movement relative to each of the legs 22, 24 during folding of step stool 10 to place step frame 12 in the COLLAPSED-STORAGE mode and during unfolding of step stool 10 to place step frame 12 in the EXPANDED-USE mode. An upper surface of each of the steps 30 is arranged generally parallel with each of the legs so that step stool 10 has a flat profile for storage in the COLLAPSED-STORAGE mode as shown in FIG. 3. The upper surface of each of the plurality of steps 30 provides a flat, horizontal surface for a user to step on when step frame 12 is in the EXPANDED-USE mode as shown in FIG. 4. In some embodiments, one or more of the plurality of steps 30 may be mounted to the rear left and right legs 26, 28 for pivotable movement relative to each of the legs 26, 28.

Figure 5:
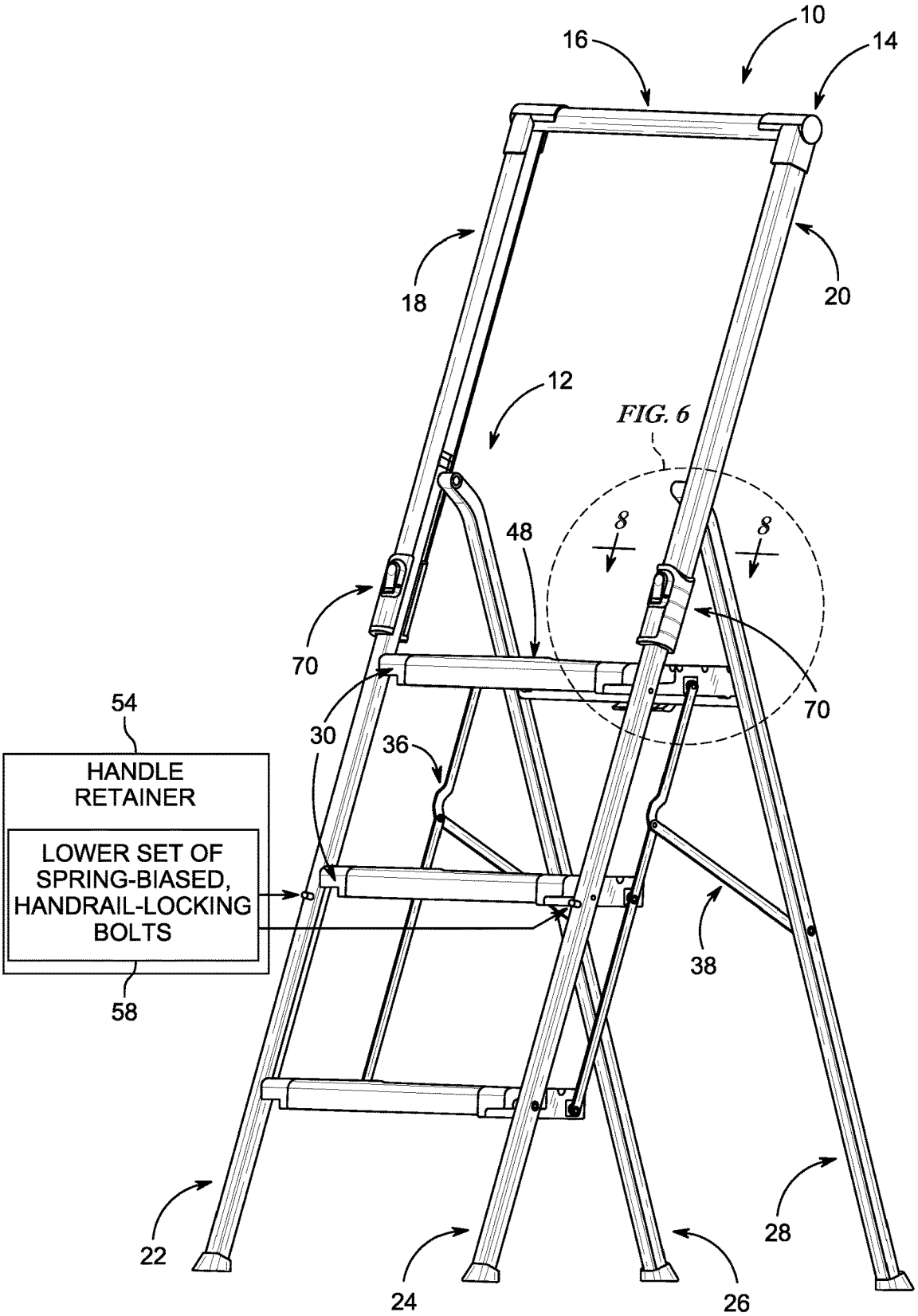
FIG. 5 is a perspective view similar to FIG. 4 showing the handrail in a raised position on the front legs of the step frame and showing exposed tips of a lower set of spring-biased, handrail-locking bolts included in the handrail retainer and mounted for forward and rearward sliding movement on the front left and right legs just below the second step and used to retain the handrail in the lowered position on the front legs of the step frame as suggested in FIGS. 1-4.

Step frame 12 may further include a pair of foldable step-support linkages 36, 38 to control pivoting motion of the steps 30 relative to the front left and right legs 22, 24 during folding and unfolding of step stool 10 as shown in FIGS. 4 and 5. Each foldable step-support linkage 36, 38 includes a first link 40, 42 that is coupled to each of the steps 30 and a second link 44, 46 that extends between and interconnects a companion one of the first link 40, 42 and a companion one of the rear left and right legs 26, 28. The first links 40, 42 are coupled to rear ends of each step 30 that is beneath a top step 48 included in the plurality of steps 30. The first links 40 42 are coupled at or near a center of top step 48 between forward and rear ends of top step 48. Second links 44, 46 interconnect respective rear left and right legs 26, 28 and respective first links 40, 42 and are arranged relative to first links 40, 42 such that folding of step frame 12 causes a rear end of each step 30 to move upwardly as each step pivots upwardly relative to front left and right legs 22, 24. In some embodiments, step frame 12 may include only one of the foldable step-support linkages 36, 38.

Rear left and right legs 26, 28 are interconnected to one another by a horizontal crossbeam 50 as shown in FIG. 4. Crossbeam 50 is located near an upper end of step frame 12 to engage top step 48 when step frame 12 is in the EXPANDED-USE mode. Additional crossbeams may be included to increase support for step stool 10. Crossbeam 50 engages a rear end of top step 48 so that top step 48 is supported in a horizontal position at front legs 22, 24 by fasteners and at rear legs 26, 28 by crossbeam 50. Loads applied on lower steps 30 are transferred to top step 48 and to crossbeam 50 by first links 40, 42. Step frame 10 may further include a lock grip 52 that is coupled to top step 48 and engages an underside of crossbeam 50 in the EXPANDED-USE mode to block upward movement of rear ends of steps 30. Lock grip 52 is pivotable relative to top step 48 to be freed from crossbeam 50 so that steps 30 may pivot upwardly to change step frame 12 from the EXPANDED-USE mode to the COLLAPSED-STORAGE mode. Lock grip 52 may pivot downwardly by gravity to lie adjacent an underside of top step 48 in the COLLAPSED-STORAGE mode so that step stool 10 maintains the flat profile for storage.

Step frame 12 further includes a handle retainer 54 comprising separate sets of upper and lower spring-biased, handrail-locking bolts 56, 58 mounted on each of the front left and right legs 22, 24 as shown in FIGS. 4 and 5. The upper and lower spring-biased, handrail locking bolts 56, 58 are biased to move relative to the front left and right legs 22, 24 to project a tip 57 of each bolt 56, 58 in a forward direction through a bolt-receiving aperture 60, 62 formed in a companion one of the legs 22, 24. Handrail 14 is blocked from sliding movement relative to front legs 22, 24 by either the upper spring-biased, handrail-locking bolts 56 or the lower spring-biased, handrail-locking bolts 58. In the lowered position, each of the lower spring-biased, handrail-locking bolts 58 is also urged to extend through a companion bolt-receiving aperture 64 formed in handrail 14 to retain handrail 14 in the lowered position on step frame 12 regardless of whether step frame 12 is in the COLLAPSED-STORAGE mode or the EXPANDED-USE mode. In the raised position, each of the upper spring-biased, handrail-locking bolts 56 is also urged to extend through the companion bolt-receiving aperture 64 formed in handrail 14 to retain handrail 14 in the raised position on step frame 12 regardless of whether step frame 12 is in the COLLAPSED-STORAGE mode or the EXPANDED-USE mode.

Figure 7:
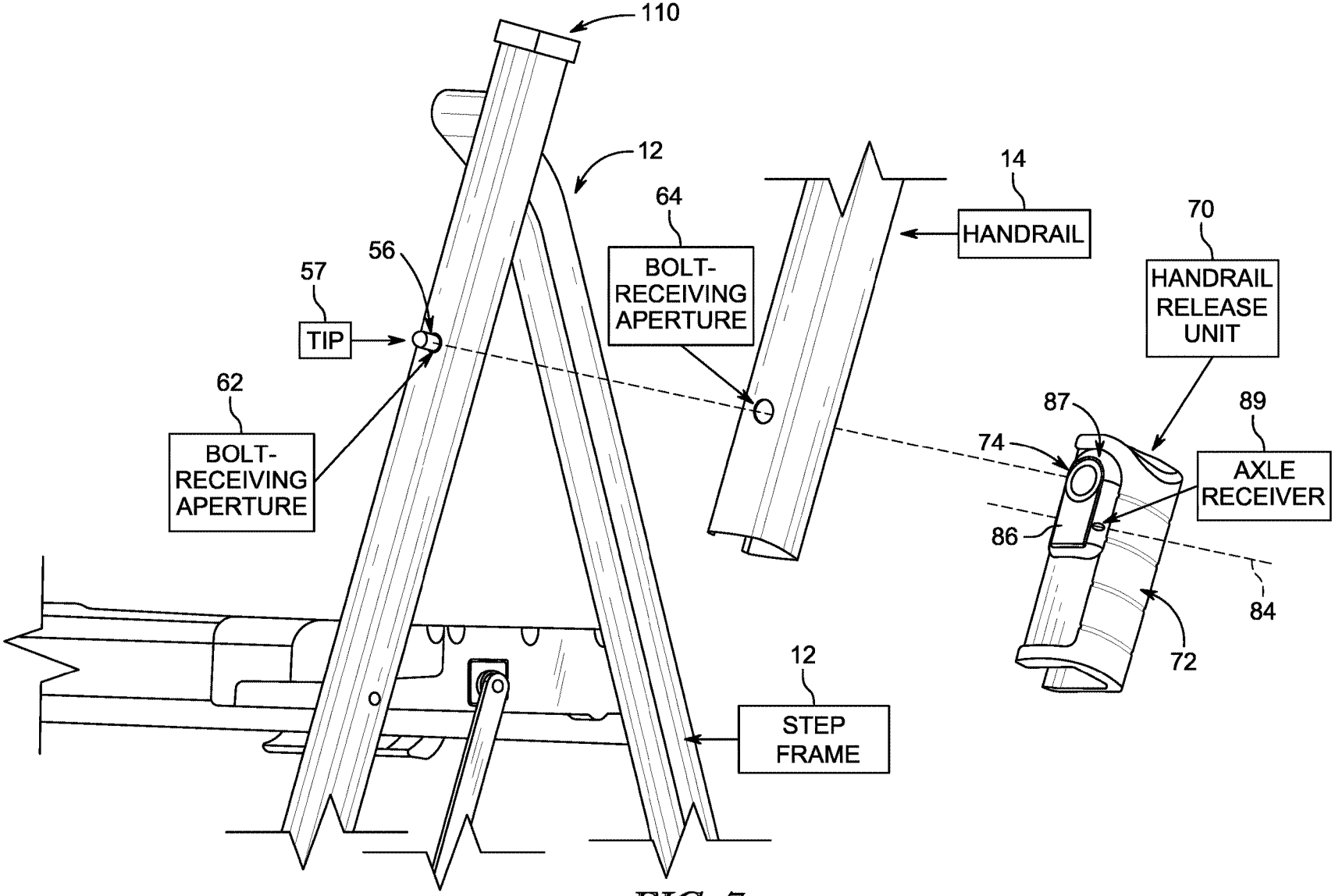
FIG. 7 is a perspective view similar to FIG. 6 but showing separation of the handrail from the front right leg of the step frame and separation of the handrail-release unit from the handrail and showing the exposed tip of one of the spring-biased, handrail-locking bolts in the upper set of bolts in the handrail retainer, the formation of a bolt-receiving aperture in the handrail to receive the tip of the bolt when the handrail is in the raised position so as to retain the handrail in the raised position on the step frame, and the alignment of the pivotable bolt pusher on the hand grip included in the handrail-release unit with the tip of the bolt so that application of a pushing force by a user to an outer face of the pivotable bolt pusher will cause the bolt pusher to pivot toward the tip of the bolt and push that tip inwardly against a spring force to exit the bolt-receiving aperture formed in the handrail and free the handrail for up-and-down sliding movement on the front legs of the step frame.
Figure 7A:
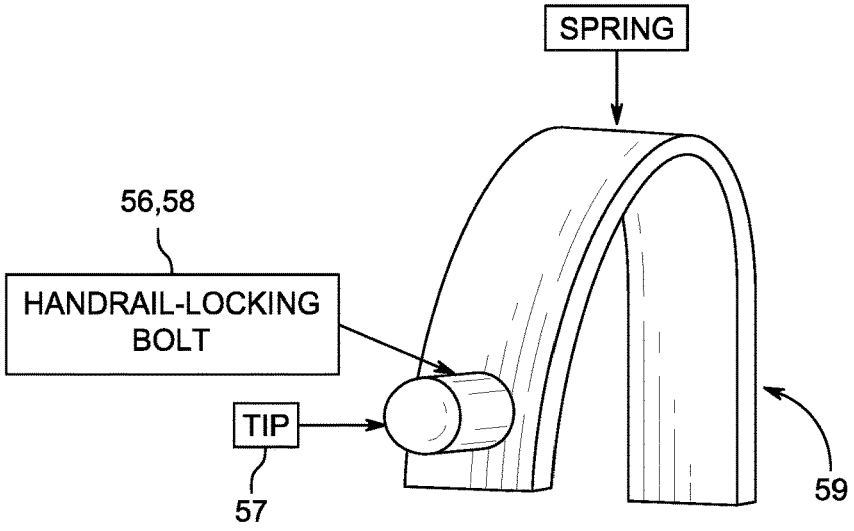
FIG. 7A is a perspective view showing that the handrail-locking bolt of FIG. 7 is coupled to a curved spring which can be mounted in a hollow chamber formed in the front first leg of the step frame as shown in FIG. 8 so that the bolt is spring-biased to yieldably urge the bolt normally in a forward direction to extend through a bolt-receiving aperture formed in the front first leg of the step frame as shown in FIG. 7.
Figure 7B:
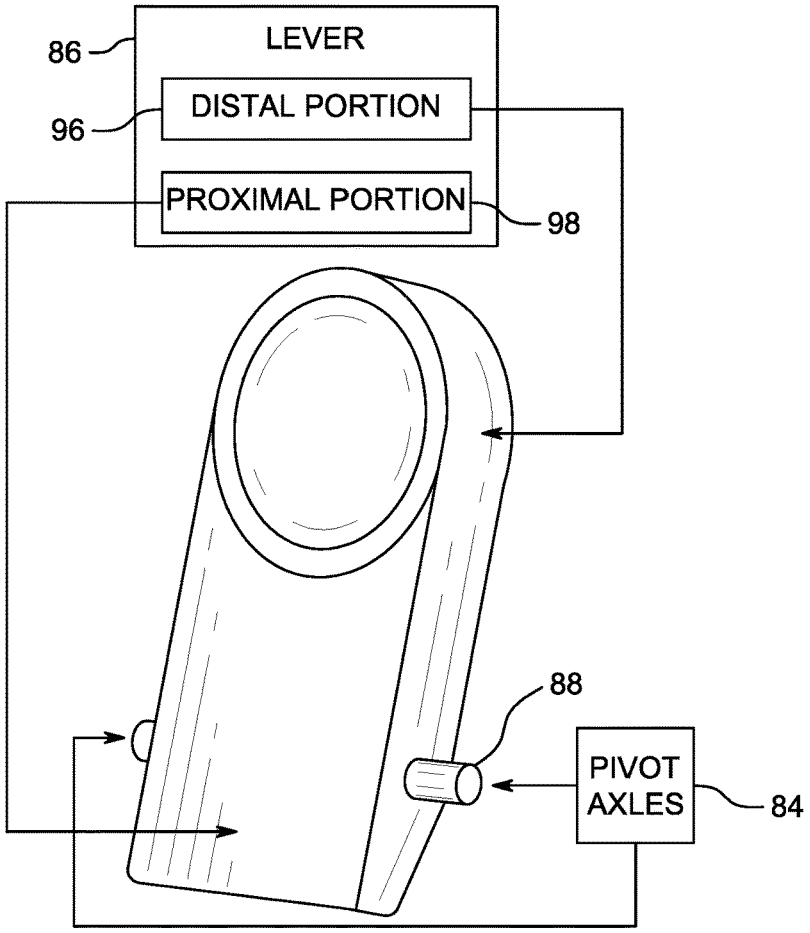
FIG. 7B is a perspective view of the pivotable bolt pusher show in FIGS. 6 and 7 and showing that the bolt pusher includes a lever having a distal portion formed to include a forwardly facing concave finger receiver and a proximal portion coupled to oppositely extending pivot axles that are sized to extend into opposing axle receivers formed in the companion hand grip to support the bolt pusher for pivotable movement about a pusher-pivot axis.

Each handle-locking bolt 56, 58 includes a tip 57 and a biasing element 59 as shown in FIG. 7A. Tip 57 is coupled to biasing element 59 and is normally forced outwardly through a bolt-receiving aperture 64 to lock handrail 14 automatically in one of the raised and lowered positions. Biasing element 59 is illustratively embodied as a plate spring that urges the tip 57 of each handle-locking bolt outward through bolt-receiving aperture 64. In some embodiments, another type of biasing element may be used such as, for example, a helical spring, a leaf spring, or a component made from a resilient material that is deformable and able to normally urge the tip 57 outwardly through bolt-receiving aperture 64.

Step stool 10 further includes a handrail-release unit 70 coupled to a lower end of each of the left and right handle-support arms 18, 20 included in handrail 14 as shown in FIGS. 4 and 5. Each handrail-release unit 70 includes a hand grip 72 coupled to the lower end of one of of the left and right handle-support arms 18, 20 and a bolt pusher 74 that is movable relative to the companion hand grip 72 by a user to apply a bolt-retracting force to the tip 57 of a companion spring-biased, handle-locking bolt 56, 58 to cause such bolt to move in a rearward direction to exit bolt-receiving aperture 64 formed in handrail 14 to free handrail 14 for up-and-down sliding movement on front legs 22, 24 of step frame 12. Each hand grip 72 is enlarged to have a greater outer dimension than handle support arms 18, 20 and front left and right legs 22, 24 to provide means for establishing an ergonomic grip for the user to grasp to move handrail 14 comfortably relative to step frame 12. Each bolt pusher 74 is sized to fit a user's thumb to allow the user to press inwardly on an outer surface of each bolt pusher 74 to release spring-biased, handle-locking bolts 56, 58 from bolt-receiving aperture 64 in each handle-support arm 18, 20.

Figure 8:
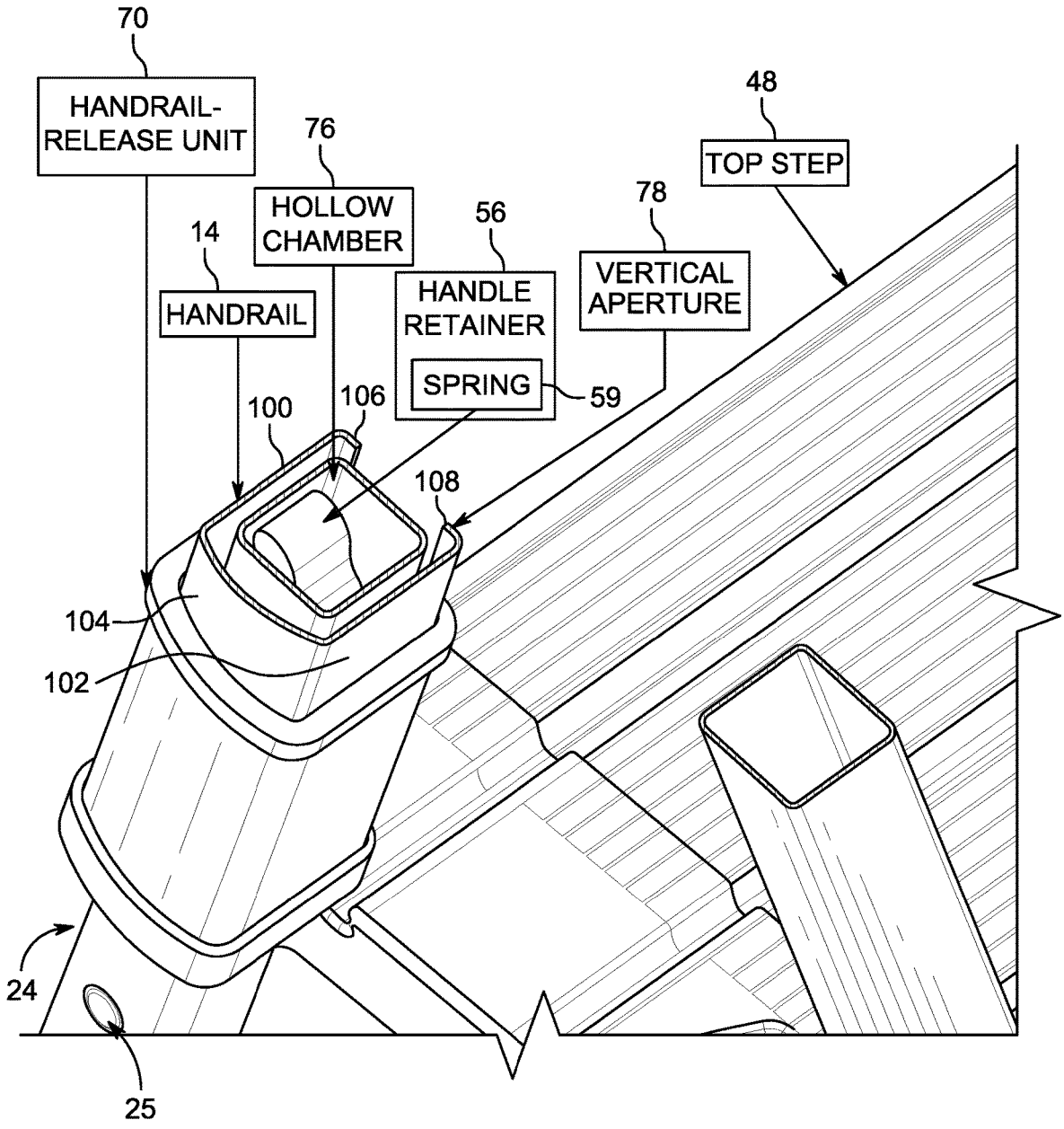
FIG. 8 is a perspective view of a remaining portion of the step stool after a section of the front right leg, the rear right leg, and the handrail is removed along section line 8-8 in FIG. 5 to show that the handle-support arm of the handrail has a C-shaped cross-sectional shape in which a vertically extending slot faces toward the steps and to show placement of the bolt-biasing spring in a hollow chamber formed in the front right leg of the step frame.

Each of the left and right handle-support arms 18, 20 of handrail 14 has a C-shaped cross-section when viewed in a direction that is parallel to front left and right legs 22, 24 as shown in FIG. 8. Left and right handle support arms 18, 20 provide a sleeve around companion front left and right legs 22, 24 and are each formed to include a hollow chamber 76 sized to receive one of the front legs 22, 24 of step frame 12 therein to facilitate up-and-down movement of each arm 18, 20 on its companion leg 22, 24. Each of the left and right handle-support arms 18, 20 is formed to include a vertically extending slot or aperture 78 along its entire length that faces and opens toward steps 30 so that hand grips 72 can move past fasteners that mount each step 30 to step frame 12 during up-and-down movement of handrail 14. Handle-support arms 18, 20 are aligned vertically so that vertically extending slots 78 face toward one another when handrail 14 is stationary and when handrail 14 moves up and down on front legs 22, 24 of step frame 12.

Handle-support arms 18, 20 each include respective front and rear panels 100, 102, a side panel 104, and front and rear side flanges 106, 108 opposite the side panel 104 as shown in FIG. 8. Flanges 106, 108 define the vertically extending slot 78 therebetween. Each of the panels 100, 102, 104 and flanges 106, 108 are spaced apart from a companion one of the front left and right legs 22, 24. Spacing is maintained between the handle-support arms 18, 20 and each companion front leg 22, 24 by spacers 110 that cap each front leg 22, 24 at upper end 32 of step frame 12 as shown in FIG. 7. The spacing between handle-support arms 18, 20 and front legs 22, 24 allows handle-support arms 18, 20 and handrail-release units 70 to clear other components mounted on front legs 22, 24 such as rivets 25 as shown in FIG. 8 during up-and-down movement of the handrail 14. Hand grip 72 may also include areas that engage a companion one of front legs 22, 24 to maintain spacing between handle-support arms 18, 20 and front legs 22, 24.

Figure 6:
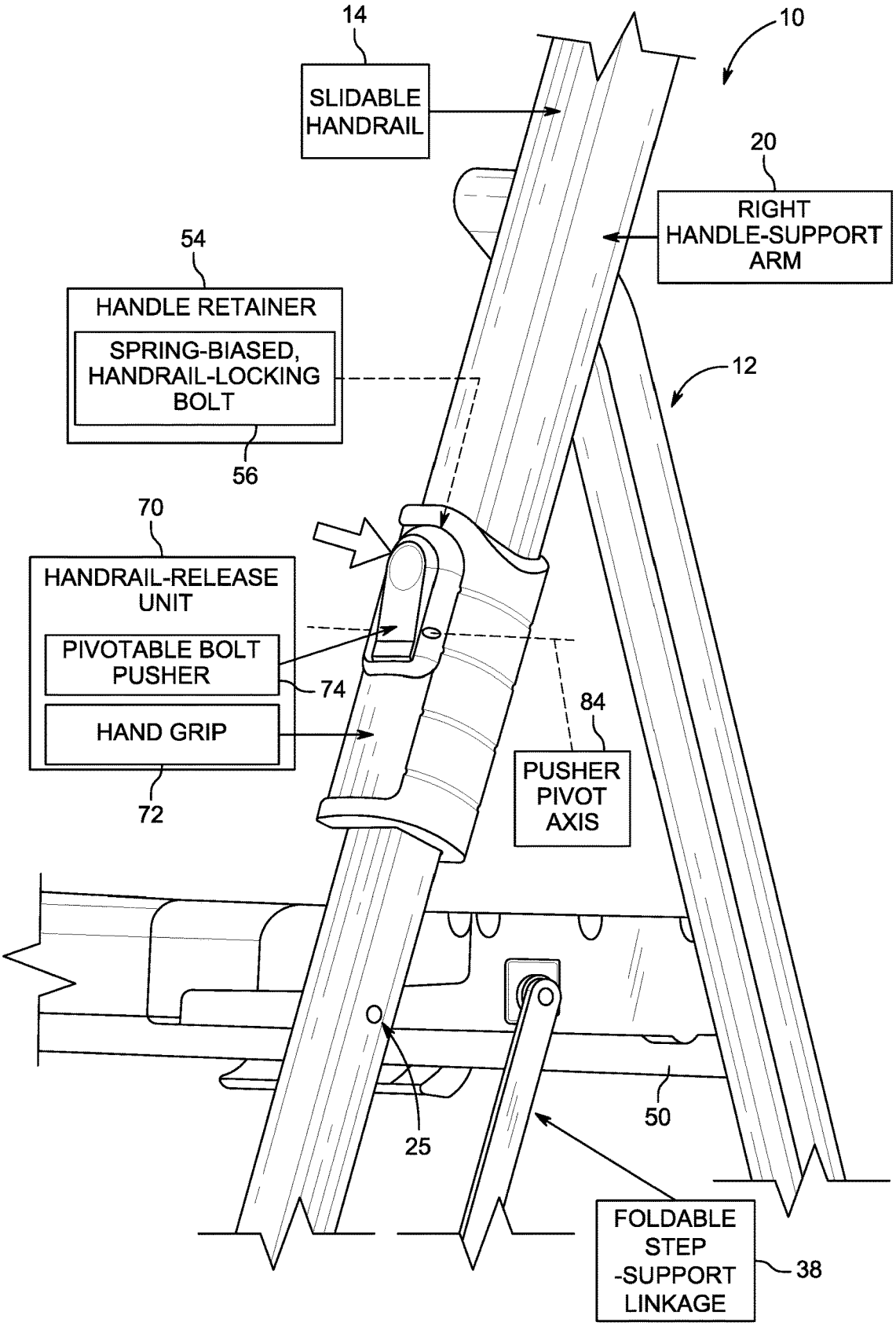
FIG. 6 is an enlarged view of a circled region of FIG. 5 showing the handrail-release unit that is coupled to a lower end of a right handle-support arm included in the handrail and configured to include a pivotable bolt pusher that can be pressed by a user to disengage the tip of the spring-biased, handrail-locking bolt (shown in FIG. 4) that is included in the handrail retainer and mounted for forward and rearward movement on an upper portion of the front right leg of the step frame as suggested in FIG. 4 and showing the handle-release unit also includes a hand grip that is mounted on a lower end of the right handle-support arm of the handrail and configured to support the bolt pusher for pivotable movement about a pusher-pivot axis.
Figure 7C:
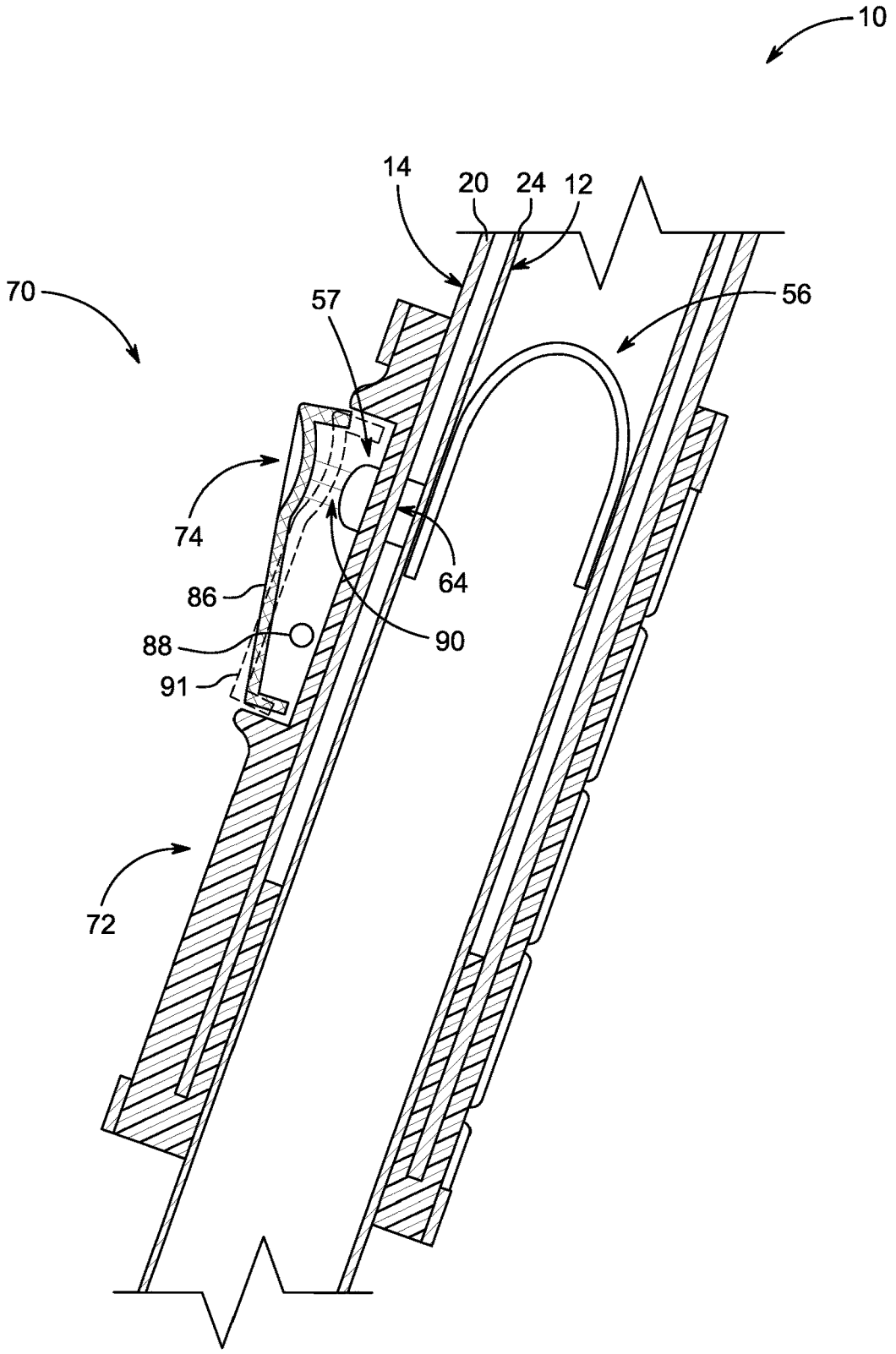
FIG. 7C is a cross-sectional view taken along line 7C-7C in FIG. 2 showing one of the handrail release units.

Each bolt pusher 74 is mounted to a companion hand grip 72 for pivotable movement about a pusher-pivot axis 84 between an extended position and a compressed position as suggested in FIGS. 6 and 6A. Pusher-pivot axis 84 is arranged to lie substantially perpendicular to handrail-support arms 18, 20 and front legs 22, 24. Each bolt pusher 74 includes a lever 86, a pusher axle 88, and a plunger 90 that extends inwardly toward the handle-locking bolts 56, 58 as shown in FIG. 7C. Lever 86 is arranged to lie in an aperture 87 formed in hand grip 72 for movement relative to hand grip 72 between the extended and compressed positions. Pusher axle 88 mounts bolt pusher 74 to hand grip 72 by extending into an axle-receiver aperture 89 that opens into aperture 87 along pusher-pivot axis 84. Plunger 90 is coupled to an inner surface 91 of lever 86 and extends inward to engage spring-biased, handle-locking bolts 56, 58. The lever 86 includes a distal portion 96 and a proximal portion 98 relative to the pusher axel 88. The plunger 90 is coupled to the distal portion 96. The proximal portion 98 tapers to decrease in thickness as it extends away from distal portion 96 to provide clearance between inner surface 91 and handle support arms 18, 20 so the bolt pusher 74 can pivot about pusher-pivot axis 84.

In operation, a user applies a force on lever 86 to pivot bolt pusher 74 about pusher-pivot axis 84. As bolt pusher 74 is pivoted about pusher-pivot axis 84, plunger 90 is forced inwardly to move handle-locking bolts 56, 58 out of bolt-receiving aperture 64 formed in handle-support arms 18, 20 thereby releasing handrail 14 for up-and-down movement relative to step frame 12. When bolt pusher 74 is not being pressed into the compressed position, the biasing element 59 of each spring-biased, handle-locking bolt 56, 58 may be sufficient to act on plunger 90 and force bolt pusher 74 into the extended position. Alternatively, bolt pusher 74 may include a separate biasing element to normally urge plunger 90 away from tip 57 of handle-locking bolts 56, 58.

Figure 9:
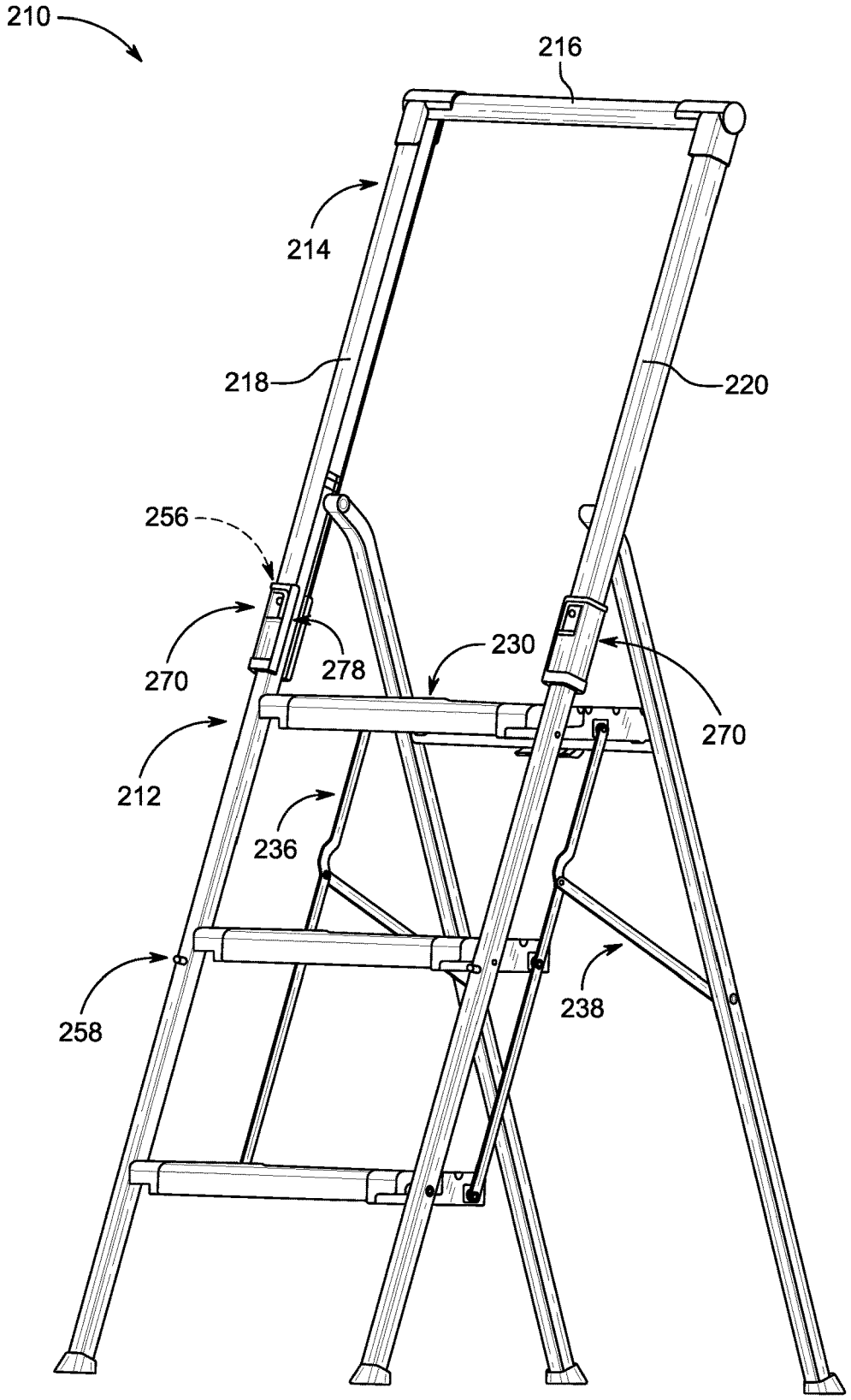
FIG. 9 is a perspective view of a step stool in accordance with a second embodiment of the present disclosure in which each handrail-release unit is a monolithic component formed to include a hand grip and a bendable elastic bolt-pusher tab coupled to the hand grip in lieu of the pivotable bolt pusher disclosed in FIGS. 1-7.
Figure 10:
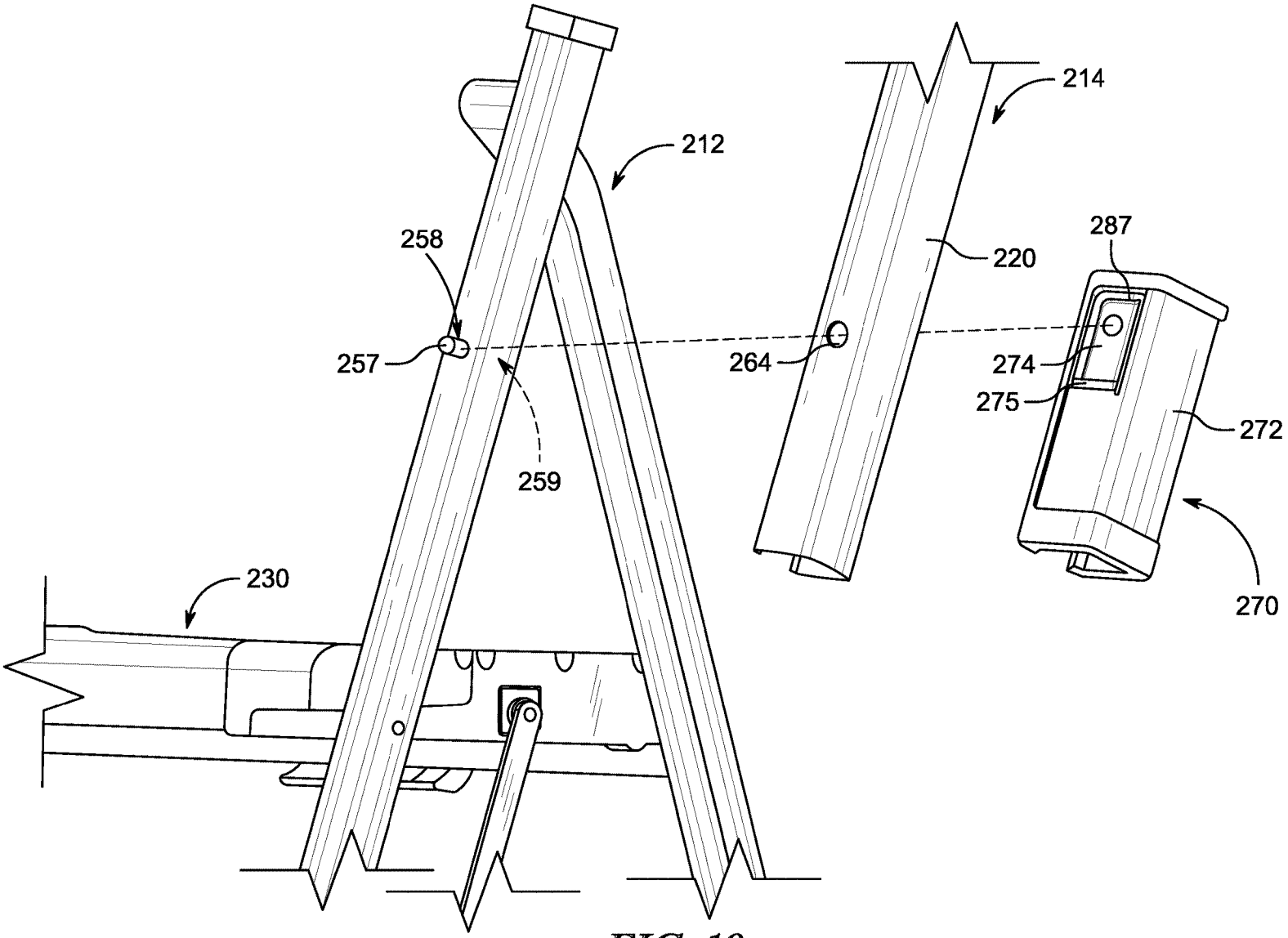
FIG. 10 is a perspective view similar to FIG. 9 (and FIG. 7) but showing separation of the handrail from the front right leg and separation of the handrail-release unit from the handrail and showing the integral coupling of the bendable elastic bolt-pusher tab to the hand grip in greater detail.

Another embodiment of a step stool 210 is shown in FIGS. 9 and 10. Step stool 210 is substantially similar to step stool 10. Accordingly, similar reference numbers in the 200 series are used to indicate similar features between step stool 210 and step stool 10. The description above for step stool 10 is hereby incorporated by reference herein for step stool 210 except for the differences explicitly described below.

Step stool 210, in accordance with the present disclosure, includes a step frame 212 and a handrail 214 movable relative to the step frame 212 between lowered and raised positions as shown in FIG. 1. Handrail 214 moves down relative to step frame 212 to assume the lowered position to save space when step stool 210 is stored in a COLLAPSED-STORAGE mode as shown in FIGS. 2 and 3 with reference to step stool 10. Handrail 214 moves up to assume the raised position to provide support for a user standing on step stool 210 when step stool 210 is in an EXPANDED-USE mode as shown in FIG. 4 with reference to step stool 10. Step stool 210 further includes a handrail-release unit 270 coupled to handrail 214 to disengage handrail from step frame 212 so that handrail 214 can move relative to step frame 212 to change between the raised and the lowered positions.

Handrail-release units 70 coupled to a lower end of one of left and right handle-support arms 218, 220 included in handrail 214 as shown in FIG. 9. Each handrail-release unit 270 includes a hand grip 272 coupled to the lower end of one of the left and right handle-support arms 218, 220 and a bolt pusher 274 that is movable relative to the companion hand grip 272 by a user to apply a bolt-retracting force to a tip 257 of a companion spring-biased, handle-locking bolt 256, 258 to cause such bolt to move in a rearward direction to exit bolt-receiving aperture 264 formed in handrail 214 to free handrail 214 for up-and-down sliding movement on front legs 222, 224 of step frame 212. Each hand grip 272 is enlarged to have a greater outer dimension than handle-support arms 218, 220 and front left and right legs 222, 224 to provide means for establishing an ergonomic grip for the user to grasp to move handrail 214 comfortably relative to step frame 212. Each bolt pusher 274 is about the size of a user's thumb to allow the user to press inwardly on an outer surface of each bolt pusher 274 to release spring-biased, handle-locking bolts 256, 258 from bolt-receiving aperture 264 in each handle-support arm 218, 220.

Each bolt pusher 274 is mounted to a companion hand grip 272 for movement relative to the hand grip 270 between an undeformed extended position and a deformed compressed position as suggested in FIG. 9. Each bolt pusher 274 is formed integrally with a companion hand grip 272 and provides a lever 286 that a user uses to apply the bolt-retracting force on the spring-biased, handle-locking bolts 256, 258. Bolt pusher 274 is arranged to lie in an aperture 287 formed in hand grip 272 for movement relative to hand grip 272 between the undeformed extended and deformed compressed positions. In operation, a user applies a force on bolt pusher 274 to deform bolt pusher 274 relative to hand grip 270 about a lower edge 275 of the bolt pusher 274. As bolt pusher 274 is deformed, the bolt pusher 274 is forced inwardly to move handle-locking bolts 256, 258 out of bolt-receiving aperture 264 formed in handle-support arms 218, 220 thereby freeing handrail 214 for up-and-down movement relative to step frame 212. When bolt pusher 274 is not being pressed into the deformed compressed position, a biasing element of each handle-locking bolt 256, 258 may be sufficient to act on bolt pusher 274 and force bolt pusher 274 into the undeformed extended position. Alternatively, bolt pusher 274 may include a separate biasing element to normally urge bolt plunger 274 away from handle-locking bolts 256, 258.

Figure 11:
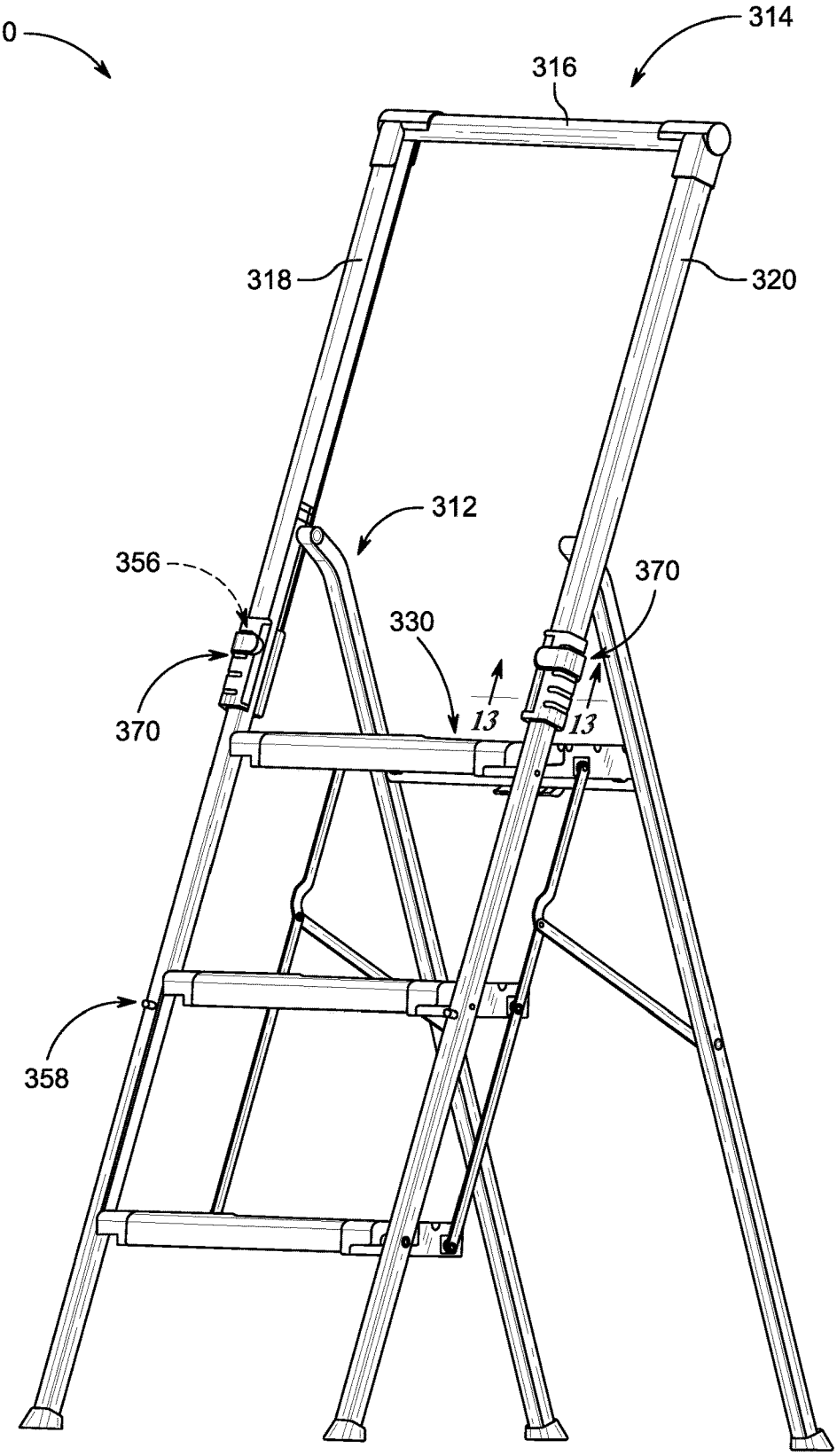
FIG. 11 is a perspective view of a step stool in accordance with a third embodiment of the present disclosure in which each handrail-release unit includes a hand grip and a bolt pusher coupled to the hand grip for pivotable movement about an axis that is parallel with each of the handle-support arms.
Figure 12:
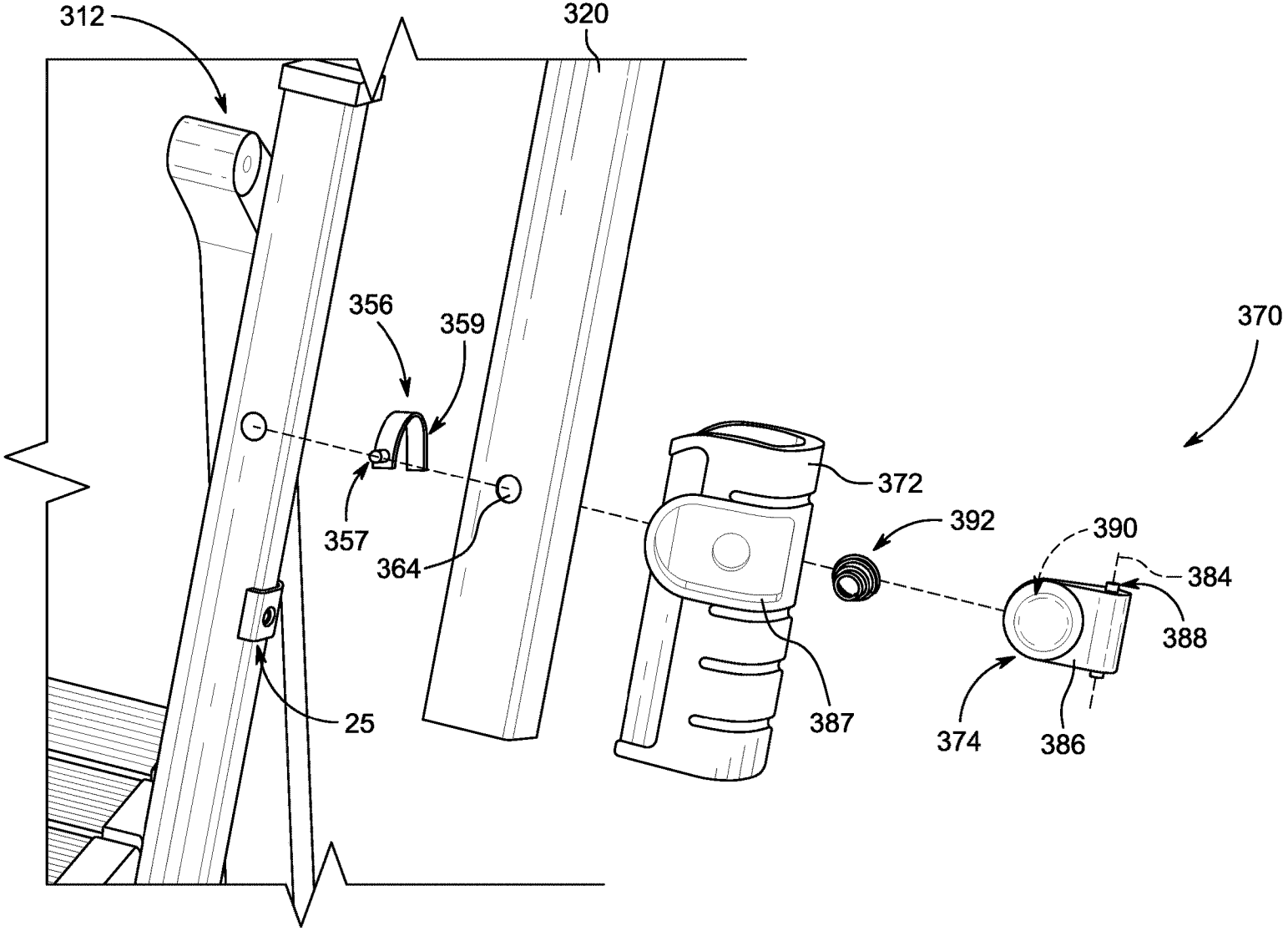
FIG. 12 is a perspective view similar to FIG. 10 showing separation of the handrail from the front right leg and separation of the handrail-release unit from the handrail.
Figure 13:
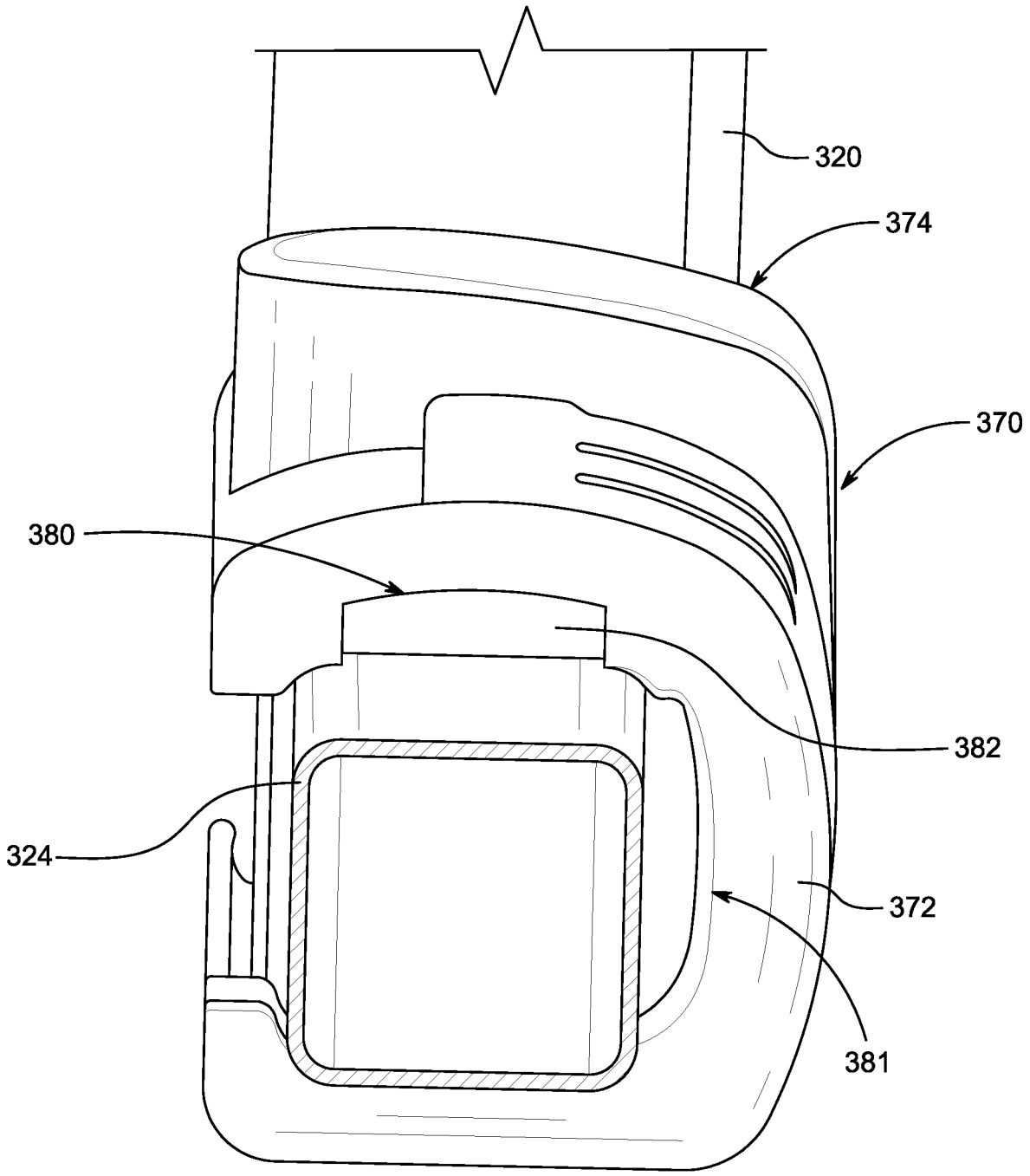
FIG. 13 is a perspective view of the step stool showing a cross section of the step frame taken along line 13-13 in FIG. 11 showing that the hand grip is formed to include a cutout and includes a ramp that compresses the handle-locking bolt as the handrail is moved downwardly from the raised position to the lowered position so that the handrail-release unit can clear the handle-locking bolt.

Another embodiment of a step stool 310 is shown in FIGS. 11-13. Step stool 310 is substantially similar to step stool 10. Accordingly, similar reference numbers in the 300 series are used to indicate similar features between step stool 310 and step stool 10. The description above for step stool 10 is hereby incorporated by reference herein for step stool 310 except for the differences explicitly described below.

Step stool 310, in accordance with the present disclosure, includes a step frame 312 and a handrail 314 movable relative to the step frame 312 between lowered and raised positions like step stool 10 shown in FIG. 1. Handrail 314 moves down relative to step frame 312 to assume the lowered position to save space when step stool 310 is stored in a COLLAPSED-STORAGE mode as shown in FIGS. 2 and 3 with reference to step stool 10. Handrail 314 moves up to assume the raised position to provide support for a user standing on step stool 310 when step stool 310 is in an EXPANDED-USE mode as shown in FIG. 4 with reference to step stool 10. Step stool 310 further includes a handrail-release unit 370 coupled to handrail 314 to disengage handrail from step frame 312 so that handrail 314 can move relative to step frame 312 to change between the raised and the lowered positions.

Each handrail-release unit 370 is coupled to a lower end of one of left and right handle-support arms 318, 320 included in handrail 314 as shown in FIG. 11. Each handrail-release unit 370 includes a hand grip 372 coupled to the lower end of one of the left and right handle-support arms 318, 320 and a bolt pusher 374 that is movable relative to the companion hand grip 372 by a user to apply a bolt-retracting force to a tip 357 of a companion spring-biased, handle-locking bolt 356, 358 to cause such bolt to move in a rearward direction to exit bolt-receiving aperture 364 formed in handrail 314 to free handrail 314 for up-and-down sliding movement on front legs 322, 324 of step frame 312. Each hand grip 372 is enlarged to have a greater outer dimension than handle-support arms 318, 320 and front left and right legs 322, 324 to provide means for establishing an ergonomic grip for the user to grasp to move handrail 314 comfortably relative to step frame 312. Each bolt pusher 374 is about the size of a user's thumb to allow the user to press inwardly on an outer surface of each bolt pusher 374 to release handle-locking bolts 356, 358 from bolt-receiving aperture 364 in each spring-biased, handle-support arm 318, 320.

Each bolt pusher 374 is mounted to a companion hand grip 372 for pivotable movement about a pusher-pivot axis 384 between an extended position and a compressed position as suggested in FIG. 12. Pusher-pivot axis 384 extends substantially parallel to handrail-support arms 318, 320. Each bolt pusher 374 includes a lever 386, a pusher axle 388, a plunger 390, and a conical compression spring 392 that extends inwardly toward the spring-biased, handle-locking bolts 356, 358. Lever 386 is arranged to lie in an aperture 387 formed in hand grip 372 for movement relative to hand grip 372 between the extended and compressed positions. Pusher axle 388 mounts bolt pusher 374 to hand grip 372 by extending into an axle aperture 393 that opens into aperture 387 along pusher-pivot axis 384. Plunger 390 is coupled to an inner surface 391 of lever 386 and extends inward to engage handle-locking bolts 356, 358.

In operation, a user applies a force on lever 386 to pivot bolt pusher 374 about pusher-pivot axis 384. As bolt pusher 374 is pivoted about pusher-pivot axis 384, plunger 390 is forced inwardly to move spring-biased, handle-locking bolts 356, 358 out of bolt-receiving aperture 364 formed in handle-support arms 318, 320 thereby releasing handrail 314 for up-and-down movement relative to step frame 312. When bolt pusher 374 is not being pressed into the compressed position, conical compression spring 392 urges the lever 386 to return to the extended position. In some embodiments, a biasing element of each handle-locking bolt 356, 358 may be sufficient to act on plunger 390 and force bolt pusher 374 into the extended position such that the conical compression spring 392 may be omitted.

Each hand grip 372 is formed to include a cutout 380 at a lower end of each hand grip 372 and includes a lower ramp 382 that extends upwardly away from cutout 380 and toward a companion one of the front left and right legs 322, 324 as shown in FIG. 13. Cutout 380 allows handle-locking bolts 356, 358 to clear a portion of hand grips 372 as handrail 314 is lowered. Lower ramp 382 is configured to engage spring-biased, handle-locking bolts 356, 358 as handrail 314 is lowered to retract spring-biased, handle-locking bolts 356, 358 so that handrail 314 is slidable from the raised position to the lowered position. A second cutout 381 is also formed in hand grip 372 that allows hand grip 372 and each respective handle-support arm 318, 320 to clear other components on front legs 322, 324 like rivets 25. Cutouts 380, 381 and/or ramp 382 may be included in step stool 10 or 210.

In some embodiments, each C-shaped handle-support arm of the handrail has a C-shaped channel to allow the movable handrail to clear fasteners (i.e. rivets) that are used to attach the steps to other parts of the step frame such as front left and right legs 22, 24. When the handrail moves relative to the front left and right legs, the heads of the rivets project into the inwardly facing vertically extending slot formed in each of the handle-support arms. A plastic bushing is provided to couple the slidable handrail to the movable step frame. The handrail is locked into the lowered or raised position on the step frame by pushing a button that depresses a VALCO™ pin thus allowing the handrail to be moved up and down on the front legs of the step frame.

The invention claimed is:

1. A step stool comprises a step frame including front left and right legs, rear left and right legs, several steps mounted for pivotable movement on the legs during folding of the step stool to place the step frame in a collapsed-storage mode and during unfolding of the step stool to place the step frame in an expanded-use mode, a handle retainer including separate sets of upper spring-biased, handrail-locking bolts mounted for lateral sliding movement on each of the front left and right legs to project a tip of each upper spring-biased, handrail-locking bolt in a forward direction through an upper bolt-receiving aperture formed in a companion one of the front left and right legs, and separate sets of lower spring-biased, handrail-locking bolts mounted for lateral sliding movement on each of the front left and right legs to project a tip of each lower spring-biased, handrail-locking bolt through a lower bolt-receiving aperture formed in a companion one of the front left and right legs, and a pair of foldable step-support linkages that are coupled to rear ends of at least some of the steps and to the rear left and right legs to control pivoting motion of the steps relative to the front left and right legs during folding and unfolding of the step stool, a slidable handrail mounted on the front left and right legs for up-and-down movement between a lowered position and a relatively higher raised position, the slidable handrail including left and right handle-support arms and a handle arranged to interconnect upper ends of the left and right handle-support arms, in the lowered position of the slidable handrail each of the lower spring-biased, handrail-locking bolts being urged to extend through a companion bolt-receiving aperture formed in the slidable handrail to retain the slidable handrail in the lowered position on the step frame regardless of whether the step frame is in the collapsed-storage mode or the expanded-use mode, in the relatively higher raised position of the slidable handrail each of the upper spring-biased, handrail-locking bolts being urged to extend through the companion bolt-receiving aperture formed in the slidable handrail to retain the slidable handrail in the relatively higher raised position on the step frame regardless of whether the step frame is in the collapsed-storage mode or the expanded-use mode, and a handrail-release unit coupled to a lower end of each of the left and right handle-support arms included in the slidable handrail, each handrail-release unit including a hand grip coupled to the lower end of one of the left and right handle-support arms and a bolt pusher that is movable relative to the companion hand grip by a user to apply a bolt-retracting force to the tip of a companion spring-biased, handrail-locking bolt to cause such bolt to move in a rearward direction to exit the companion bolt-receiving aperture formed in the handrail when the handrail is in the lowered position and to exit the companion bolt-receiving aperture formed in the handrail when the handrail is in the relatively higher raised position to free the handrail for up-and-down movement on the front legs of the step frame, wherein each of the left and right handle-support arms of the handrail has a C-shaped cross-section and is a sleeve that is formed to include an interior region sized to receive one of the front legs of the step frame therein to facilitate up-and-down movement of each handle-support arm on its companion leg, wherein the left handle-support arm of the slidable handrail includes a front panel, a rear panel arranged to lie in spaced-apart relation to the front panel and between the front and rear left legs, and a left side panel arranged to interconnect outer edges of the front and rear panels to establish the C-shaped cross-section of the left handle-support arm and wherein the front panel of the left handle-support arm is formed to include a left bolt-receiving aperture to cause alignment of the left bolt-receiving aperture with the lower bolt-receiving aperture formed in the left front leg when the slidable handrail is retained in the lowered position and alternatively with the upper bolt-receiving aperture formed in the left front leg when the slidable handrail is retained in the relatively higher raised position.

2. The step stool of claim 1, wherein the left front leg is formed to include a hollow chamber, each of the upper and lower spring-biased, handrail-locking bolts associated with the left front leg includes a spring located in the hollow chamber of the left front leg and a bolt head formed to include the exposed tip, and the spring is coupled to the bold head and wherein the spring of the lower spring-biased, handrail-locking bolt associated with the left front leg is arranged to engage a lower interior surface of the left front leg in the hollow chamber to urge the exposed tip of the bolt head of the lower spring-biased, handrail-locking bolt associated with the left front leg in a forward direction normally to extend through the lower bolt-receiving aperture formed in the left front leg and temporarily to extend through the left bolt-receiving aperture formed in the left handle-support arm of the slidable handrail when the slidable handrail is retained in the lowered position, and wherein the spring of the upper spring-biased, handrail-locking bolt associated with the left front leg is arranged to engage an upper interior surface of the left front leg in the hollow chamber to urge the exposed tip of the upper spring-biased, handrail-locking bolt associated with the left front leg in a forward direction normally to extend through the upper bolt-receiving aperture formed in the left front leg and temporarily to extend through the left bolt-receiving aperture formed in the left handle-support arm of the slidable handrail when the slidable handrail is retained in the relatively higher raised position.

3. The step stool of claim 1, wherein each of the left and right handle-support arms of the slidable handrail is formed to include a longitudinally extending slot opening along its length toward at least one of the several steps when the slidable handrail occupies the lowered position, the front left leg is arranged to extend into the longitudinally extending slot formed in the left handle-support arm for up-and-down movement therein, the front right leg is arranged to extend into the longitudinally extending slot formed in the right handle-support arm for up-and-down movement therein, and the left and right handle-support arms are aligned so that their longitudinally extending slots face toward one another when the handrail is stationary and when the slidable handrail moves up and down on the front left and right legs of the step frame between the lowered position and the relatively higher raised position.

4. The step stool of claim 3, wherein the left and right handle-support arms of the slidable handrail are arranged to lie in spaced-apart parallel relation to one another and the front left and right legs of the step frame are arranged to lie in spaced-apart parallel relation to one another.

5. The step stool of claim 4, wherein the several steps include, in series, a lowest first step, a middle second step, and a highest third step, the left front leg is formed to include the lower bolt-receiving aperture located below the middle second step and above the lowest first step, the lower spring-biased, handrail-locking bolt associated with the left front leg is arranged to extend through the lower bolt-receiving aperture to project the exposed tip of the lower spring-biased, handrail-locking bolt outwardly away from the left rear leg to extend through the left bolt-receiving aperture formed in the left handle-support arm of the slidable handrail when the slidable handrail is in the lowered position to retain the slidable handrail temporarily in the lowered position, the left front leg is formed to include the upper bolt-receiving aperture located above the highest third step, the upper spring-biased, handrail-locking bolt associated with the left front leg is arranged to extend through the upper bolt-receiving aperture to project the exposed tip of the upper spring-biased, handrail-locking bolt outwardly away from the left rear leg to extend through the left bolt-receiving aperture formed in the left handle-support arm of the slidable handrail when the slidable handrail is in the relatively higher raised position to retain the slidable handrail temporarily in the relatively higher raised position, and the handrail-release unit coupled to the lower end of the left handle-support arm of the slidable handrail is configured to include the movable bolt pusher that is arranged to move relative to the left handle-support arm in response to the force applied by the user to the movable bolt pusher to cause the exposed tip of the lower spring-biased, handrail-locking bolt to exit from the left bolt-receiving aperture formed in the left handle-support arm of the slidable handrail without discharging the lower spring-biased, handrail-locking bolt from the lower bolt-receiving aperture formed in the left front leg when the slidable handrail is retained temporarily in the lowered position to free the left handle-support arm of the slidable handrail to be moved up and down on the front left leg of the step frame and to cause the exposed tip of the upper spring-biased, handrail-locking bolt to exit from the left bolt-receiving aperture formed in the left handle-support arm of the slidable handrail without discharging the upper spring-biased, handrail-locking bolt from the upper bolt-receiving aperture formed in the left front leg when the slidable handrail is retained temporarily in the relatively higher raised position to free the left handle-support arm of the slidable handrail to be moved up and down on the front left leg of the step frame.

6. The step stool of claim 5, wherein the left front leg is formed to include a hollow chamber, each of the upper and lower spring-biased, handrail-locking bolts includes a curved spring strip located in the hollow chamber of the left front leg and arranged to act against interior surfaces of the left front leg and a bolt head formed to include the exposed tip and cantilevered to the curved spring strip to cause the curved spring strip to yieldably urge the exposed tip of the bolt head in a forward direction normally to extend through the left bolt-receiving aperture of the left front leg, and the curved spring strip is configured to deform temporarily to permit movement of the bolt head in the left bolt-receiving aperture of the left front leg to disengage the left handle-support arm of the slidable handrail in response to exposure of the exposed tip to the force applied by the movable bolt pusher during movement of the movable bolt pusher relative to the left handle-support arm.

7. A step stool comprises a step frame including front left and right legs, rear left and right legs, several steps mounted for pivotable movement on the legs during folding of the step stool to place the step frame in a collapsed-storage mode and during unfolding of the step stool to place the step frame in an expanded-use mode, a handle retainer including a set of spring-biased, handrail-locking bolts mounted for lateral sliding movement to project a tip of each spring-biased, handrail-locking bolt through at least one of an upper bolt-receiving aperture formed in each of the front left and right legs or a lower bolt-receiving aperture formed in each of the front left and right legs, and a pair of foldable step-support linkages that are coupled to rear ends of at least some of the steps and to the rear left and right legs to control pivoting motion of the steps relative to the front left and right legs during folding and unfolding of the step stool, a slidable handrail mounted on the front left and right legs for up-and-down movement between a lowered position and a relatively higher raised position, the slidable handrail including left and right handle-support arms and a handle arranged to interconnect upper ends of the left and right handle-support arms, in the lowered position of the slidable handrail corresponding bolt-receiving apertures formed in each of the left and right handle-support arms is aligned with the lower bolt-receiving aperture formed in each of the front left and right legs, in the relatively higher raised position of the slidable handrail the corresponding bolt-receiving aperture formed in each of the left and right handle-support arms is aligned with the upper bolt-receiving aperture formed in each of the front left and right legs, and a handrail-release unit coupled to a lower end of each of the left and right handle-support arms included in the slidable handrail, each handrail-release unit including a hand grip coupled to the lower end of the left and right handle-support arms and a bolt mover that is movable relative to the hand grip by a user to apply a bolt-retracting force to the spring-biased, handrail-locking bolt to cause such bolt to move and exit the corresponding bolt-receiving aperture formed in the left and right handle-support arms to free the slidable handrail for up-and-down movement on the front legs of the step frame, wherein each of the left and right handle-support arms of the slidable handrail has a C-shaped cross-section and is a sleeve that is formed to include an interior region sized to receive one of the front legs of the step frame therein to facilitate up-and-down movement of each handle-support arm on its companion leg, wherein the left handle-support arm of the slidable handrail includes a first panel, a second panel arranged to lie in spaced-apart relation to the first panel, and a third panel arranged to interconnect outer edges of the first and second panels to establish the C-shaped cross-section of the left handle-support arm and wherein the first panel of the left handle-support arm is formed to include a left bolt-receiving aperture to cause alignment of the left bolt-receiving aperture with at least one of the lower bolt-receiving aperture formed in the left front leg when the slidable handrail is retained in the lowered position and alternatively with the upper bolt-receiving aperture formed in the left front leg when the slidable handrail is retained in the relatively higher raised position.

8. The step stool of claim 7, wherein the left front leg is formed to include a hollow chamber, the spring-biased, handrail-locking bolt associated with the left front leg includes a spring configured to urge the tip of the bolt to extend through at least one of the lower bolt-receiving aperture or the upper bolt-receiving aperture formed in the left front leg and through the left bolt-receiving aperture formed in the left handle-support arm of the slidable handrail when the left bolt-receiving aperture is aligned with the lower bolt-receiving aperture or the upper bolt-receiving aperture.

9. The step stool of claim 7, wherein each of the left and right handle-support arms of the slidable handrail is formed to include a longitudinally extending slot opening along its length toward at least one of the several steps when the slidable handrail occupies the lowered position, the front left leg is arranged to extend into the longitudinally extending slot formed in the left handle-support arm for up-and-down movement therein, the front right leg is arranged to extend into the longitudinally extending slot formed in the right handle-support arm for up-and-down movement therein, and the left and right handle-support arms are aligned so that their longitudinally extending slots face toward one another when the handrail is stationary and when the slidable handrail moves up and down on the front left and right legs of the step frame between the lowered position and the relatively higher raised position.

10. The step stool of claim 9, wherein the left handle-support arm of the slidable handrail further includes a first flange and a second flange, the first flange and the second flange arranged to lie in spaced-apart parallel relation the third panel to define at least a portion of the longitudinally extending slot.

11. The step stool of claim 9, wherein the left and right handle-support arms of the slidable handrail are arranged to lie in spaced-apart parallel relation to one another and the front left and right legs of the step frame are arranged to lie in spaced-apart parallel relation to one another.

12. The step stool of claim 11, wherein the several steps include, in series, a lowest first step, a middle second step, and a highest third step, the left front leg is formed to include the lower bolt-receiving aperture located below the highest third step and above the lowest first step, the left front leg is formed to include the upper bolt-receiving aperture located above the highest third step, and the handrail-release unit coupled to the lower end of the left handle-support arm of the slidable handrail is configured to include the bolt mover that is arranged to move relative to the left handle-support arm in response to the force applied by the user to the bolt mover to cause the tip of the spring-biased, handrail-locking bolt to exit the left bolt-receiving aperture formed in the left handle-support arm of the slidable handrail.

13. The step stool of claim 7, wherein the hand grip of each handrail-release unit has a C-shaped cross-section and is mounted on the first panel, the second panel, and the third panel, and the bolt mover of each handrail-release unit is mounted on the first panel.

14. The step stool of claim 13, wherein the set of spring-biased, handrail-locking bolts includes a left bolt configured to lock the left front leg to the left handle-support arm and a right bolt configured to lock the right front leg to the right handle-support arm, the left bolt includes a spring configured to urge the tip of the left bolt to extend through at least one of the lower bolt-receiving aperture or the upper bolt-receiving aperture formed in the left front leg and through the left bolt-receiving aperture formed in the left handle-support arm of the slidable handrail when the left bolt-receiving aperture is aligned with the lower bolt-receiving aperture or the upper bolt-receiving aperture of the left front legs.

15. The step stool of claim 14, wherein the tip of the left bolt is normally forced through at least one of the lower bolt-receiving aperture or the upper bolt-receiving aperture formed in the left front leg and through the left bolt-receiving aperture formed in the left handle-support arm of the slidable handrail when the left bolt-receiving aperture is aligned with the lower bolt-receiving aperture or the upper bolt-receiving aperture to automatically lock the slidable handrail in one of the lowered position or the relatively higher raised position.

16. The step stool of claim 7, wherein the left handle-support arm of the slidable handrail further includes a first flange and a second flange, the first flange and the second flange located opposite the third panel to define a longitudinally extending slot of the left handle-support arm opening along a length of the left handle-support arm toward at least one of the several steps when the slidable handrail occupies the lowered position, the front left leg is arranged to extend into the longitudinally extending slot formed in the left handle-support arm for up-and-down movement therein.

17. A step stool comprises:

a step frame including front left and right legs, rear left and right legs, several steps mounted for pivotable movement on the legs during folding of the step stool to place the step frame in a collapsed-storage mode and during unfolding of the step stool to place the step frame in an expanded-use mode, a handle retainer including a left handrail-locking bolt and a right handrail-locking bolt mounted for lateral sliding movement to project a tip of each bolt through at least one of an upper bolt-receiving aperture formed in each of the front left and right legs or through a lower bolt-receiving aperture formed in each of the front left and right legs, and a pair of foldable step-support linkages that are coupled to rear ends of at least some of the steps and to the rear left and right legs to control pivoting motion of the steps relative to the front left and right legs during folding and unfolding of the step stool, a slidable handrail mounted on the front left and right legs for up-and-down movement between a lowered position and a relatively higher raised position, the slidable handrail including left and right handle-support arms and a handle arranged to interconnect upper ends of the left and right handle-support arms, and a handrail-release unit coupled to a lower end of each of the left and right handle-support arms included in the slidable handrail, each handrail-release unit including a bolt releaser that is movable relative to the left and right handle-support arms by a user to apply a bolt-retracting force to the corresponding handrail-locking bolt to cause such bolt to move and exit at least one of the upper bolt-receiving aperture when the handrail is in the relatively higher raised position or the lower bolt-receiving aperture when the handrail is in the lowered position to free the handrail for up-and-down movement on the front legs of the step frame, wherein each handrail-release unit has a C-shaped cross-section and is a sleeve that is formed to include an interior region sized to receive one of the front legs of the step frame therein to facilitate up-and-down movement of each handle-support arm on its companion leg, wherein the handrail-release unit includes a first panel, a second panel arranged to lie in spaced-apart relation to the first panel, and a third panel arranged to interconnect outer edges of the first and second panels to establish the C-shaped cross-section.

18. The step stool of claim 17, wherein the left and right handle-support arms of the slidable handrail are arranged to lie in spaced-apart parallel relation to one another and the front left and right legs of the step frame are arranged to lie in spaced-apart parallel relation to one another.

19. The step stool of claim 17, wherein the several steps include, in series, a lowest first step, a middle second step, and a highest third step, the left front leg is formed to include the lower bolt-receiving aperture located below the highest third step and above the lowest first step, the left front leg is formed to include the upper bolt-receiving aperture located above the highest third step, and the handrail-release unit coupled to the lower end of the left handle-support arm of the slidable handrail is configured to include the bolt releaser that is arranged to move relative to the left handle-support arm in response to the force applied by the user to the bolt releaser to cause the tip of the left handrail-locking bolt to exit from at least one of the upper bolt-receiving aperture or the lower bolt-receiving aperture.

20. The step stool of claim 17, wherein each handrail-release unit is sized to receive the corresponding front leg and the corresponding handle-support arm therein so that the handrail-release unit surrounds the corresponding front leg on at least three sides.

* * * * *